US007515027B2

(12) United States Patent
Lee et al.

(10) Patent No.: US 7,515,027 B2
(45) Date of Patent: Apr. 7, 2009

(54) SHREDDED PARALLEL STACKED INDUCTOR

(75) Inventors: Jae-sup Lee, Yongin-si (KR); Sung-nam Kim, Jeju-si (KR); Seong-soo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 597 days.

(21) Appl. No.: 11/353,963

(22) Filed: Feb. 15, 2006

(65) Prior Publication Data

US 2006/0192645 A1 Aug. 31, 2006

(30) Foreign Application Priority Data

Feb. 15, 2005 (KR) ..... 10-2005-0012259

(51) Int. Cl.
*H01F 5/00* (2006.01)

(52) U.S. Cl. ..... 336/200

(58) Field of Classification Search ..... 336/65, 336/83, 200, 206–208, 232; 257/531
See application file for complete search history.

(56) References Cited

U.S. PATENT DOCUMENTS 5,852,866 A * 12/1998 Kuettner et al. ..... 29/608
6,194,987 B1 * 2/2001 Zhou et al. ..... 336/200
6,806,558 B2 * 10/2004 Apel ..... 257/663
6,882,240 B2 * 4/2005 Apel ..... 333/25
6,885,275 B1 * 4/2005 Chang ..... 336/200

* cited by examiner

*Primary Examiner*—Tuyen T. Nguyen
(74) *Attorney, Agent, or Firm*—Sughrue Mion, PLLC

(57) ABSTRACT

A shredded parallel stacked inductor is provided. The shredded parallel stacked inductor includes a substrate, an oxide film formed on the substrate, metallic layers spirally formed within the oxide film, and vias formed in regions of the metallic layers to join the metallic layers in parallel, thus forming a spiral cavity in a center part of the metallic layers.

8 Claims, 4 Drawing Sheets

SHREDDED PARALLEL STACKED INDUCTOR

CROSS-REFERENCE TO RELATED APPLICATIONS

This application claims benefit under 35 U.S.C. §119 from Korean Patent Application No. 2005-12259, filed on Feb. 15, 2005 in the Korean Patent Office, the entire content of which is incorporated herein by reference.

BACKGROUND OF THE INVENTION

1. Field of the Invention

Apparatuses consistent with the present invention relate to an inductor, and more particularly, to a shredded parallel stacked inductor having a high quality factor by reducing a loss resulted from a skin effect created in metallic layers of the inductor.

2. Description of the Related Art

In general, a transceiver is a device for transmitting and receiving signals between communication appliances, and is used in diverse fields such as code division multiple access (CDMA), global system for mobile communications (GSM), wireless local area network (WLAN), ultra wideband (UWB), and other such communications fields known in the art. Such a transceiver includes constituent parts such as a voltage controlled oscillator, a low-noise amplifier (LNA), a mixer, a power amplifier, an LC filter, and other components well known in the art.

An inductor is used in the respective constituent parts of the transceiver, and a demand for an inductor having a high Q factor is recently rising. For example, the core of a design for reducing the phase noise of the voltage controlled oscillator is to employ an inductor having a high quality (Q) factor. Additionally, an inductor having a high Q factor is necessary to integrate the voltage controlled oscillator, the power amplifier, the mixer, and other known components into the transceiver.

The Q factor has a close relation with a skin effect. In order to implement the inductor having the high Q factor, a loss resulting from the skin effect created in the inductor must be reduced.

The term "skin effect" means the tendency of a high-frequency current to distribute itself within a conductor, such as metal, so that the current density near a surface of the conductor is greater than that at its core, i.e. the current tends to flow at the skin of the conductor. The reason why the skin effect occurs is that as the direction of current flowing through the conductor is abruptly changed, an induced electromotive force is produced within the conductor, and this force makes it difficult for the current to flow through the center part of the conductor. When the skin effect is created, the thickness with which the current can penetrate the conductor is called a skin thickness, which can be expressed by Equation (1), $$\delta = \frac{1}{\sqrt{\pi f \mu_O \sigma}} \tag{1}$$

In Equation (1), $\delta$ denotes a skin thickness, f denotes a frequency, $\mu_0$ denotes permeability in a vacuum, and a denotes a conductivity of the conductor. In Equation (1), $\pi$ and $\mu_0$ are fixed values, respectively.

Referring to Equation (1), as the conductivity of the conductor and the frequency of the current applied to the conductor become high, the skin thickness is decreased. Recently, an aluminum metallic layer of the inductor has been replaced with a copper metallic layer in order to implement an inductor having a high Q factor. The copper has a characteristic that the conductivity of the copper is about 56% higher than that of the aluminum. Also, the frequency of the electric current applied to the inductor is heightened as time goes on.

As the conductivity of the metallic layer and the frequency of the current applied to the inductor increase, the loss resulting from the skin effect is increased, and this loss causes the Q factor of the inductor to be reduced.

SUMMARY OF THE INVENTION

The present invention addresses the above drawbacks and other problems associated with the conventional arrangement. An aspect of the present invention is to provide a shredded parallel stacked inductor which can improve the Q factor of an inductor by minimizing a skin effect occurring when an electric current is applied to the inductor and by reducing a DC resistance of metallic layers of the inductor.

According to an exemplary embodiment of the present invention, a shredded parallel stacked inductor is provided which comprises a substrate, an oxide film formed on the substrate, a plurality of metallic layers spirally formed within the oxide film, and a plurality of vias formed in regions of the plurality of metallic layers to join the plurality of metallic layers in parallel, wherein a spiral cavity is formed in the plurality of metallic layers.

The regions of the plurality of metallic layers may include proximal parts, distal parts and corner parts of the metallic layers.

The spiral cavity may be formed in center parts of the plurality of metallic layers except for the proximal and distal parts of the metallic layers.

Current depletion areas of the metallic layers may be reduced by the cavity when electric current is applied.

The shredded parallel stacked inductor may have a structure stacked in parallel through the vias.

The long side of the metallic layer may have a length of about 10 μm, and the short side of the metallic layer may have a length of about 3 μm.

BRIEF DESCRIPTION OF THE DRAWINGS

The above and other aspects of the present invention will be more apparent to one having skill in the art by describing certain exemplary embodiments of the present invention with reference to the accompanying drawings, in which.

DETAILED DESCRIPTION OF EXEMPLARY EMBODIMENTS OF THE PRESENT INVENTION

Figure 1:
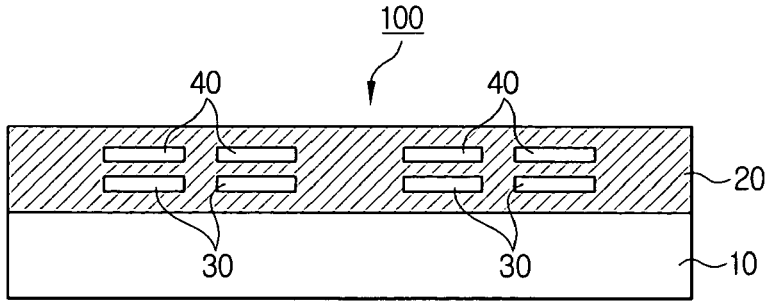
FIG. 1 is a sectional view of a shredded parallel stacked inductor according to an exemplary embodiment of the present invention.

Certain exemplary embodiments of the present invention will be described in greater detail with reference to the accompanying drawings.

In the following description, same drawing reference numerals are used for the same elements even in different drawings. The matters defined in the description such as a detailed construction and elements are only provided to assist one having skill in the art with a comprehensive understanding of the invention. Thus, it is apparent that the present invention can be carried out without those defined matters. Also, well-known functions or constructions are not described in detail since they would obscure the invention in unnecessary detail.

FIG. 1 is a sectional view illustrating a shredded parallel stacked inductor according to an exemplary embodiment of the present invention. Referring to FIG. 1, the shredded parallel stacked inductor 100 includes a silicon substrate 10, an oxide film 20 formed on the silicon substrate 10 through a complementary metal-oxide semiconductor (CMOS) process, or other process known in the art, and a plurality of metallic layers, e.g. first and second metallic layers 30 and 40, spirally formed within the oxide film 20. Although not shown in FIG. 1, specified regions of the first and second metallic layers 30 and 40 are joined by vias (See FIG. 4).

Figure 2:
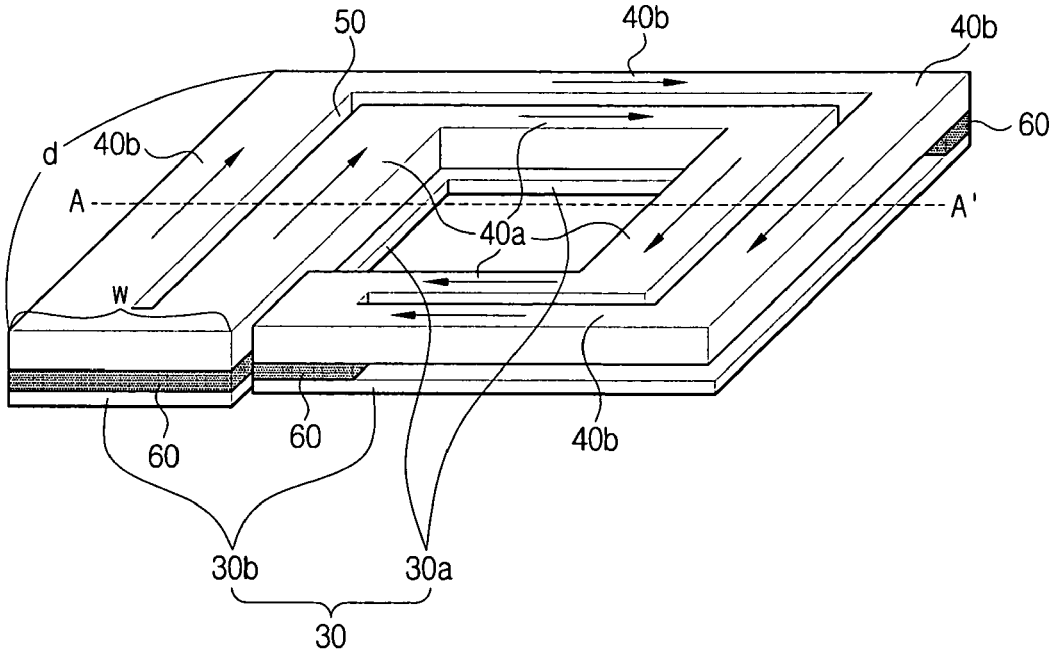
FIG. 2 is a schematic view illustrating the structure of metallic layers in FIG. 1 in detail.
Figure 3:
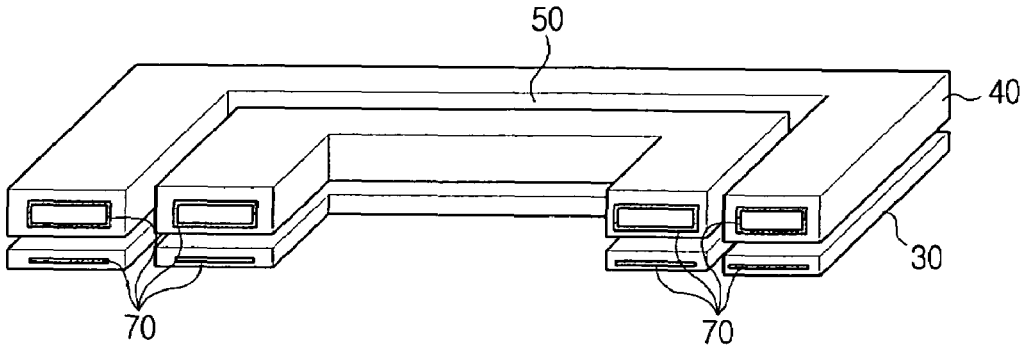
FIG. 3 is a sectional view taken along the line A-A' in FIG. 2.

FIG. 2 is a schematic view illustrating the structure of the metallic layers in FIG. 1 in detail, and FIG. 3 is a sectional view taken along the line A-A' in FIG. 2. The structure and operation of the shredded parallel stacked inductor according to an exemplary embodiment of the present invention will now be described with reference to FIGS. 2 and 3.

First, referring to FIG. 2, the first and second metallic layers 30 and 40 have a structure in which a cavity 50 is formed in the center of a spiral conductor. The cavity 50 is formed in the center part of the spiral conductor, i.e., the plural metallic layers 30 and 40, at predetermined intervals, and has the same spiral arrangement as those of the plural metallic layers 30 and 40. In this case, the cavity is not formed at the proximal and distal parts of the first and second metallic layers 30 and 40. In an exemplary embodiment of the present invention, long sides (d) of the first and second metallic layers 30 and 40 have a width of about 10 μm, and short sides (w) have a width of about 3 μm.

In the following description, for convenience in explanation, the first metallic layer 30 inside the cavity is defined as the first inner metallic layer 30*a*, and the first metallic layer 30 outside the cavity is defined as the first outer metallic layer 30*b*. Similarly, the second metallic layer 40 inside the cavity is defined as the second inner metallic layer 40*a*, and the second metallic layer 40 outside the cavity is defined as the second outer metallic layer 40*b*. If the electric current is applied to the first and second metallic layers 30 and 40, it flows in a direction indicated by arrow in FIG. 2. The respective metallic layers 30 and 40 are junctioned in parallel by the vias 60.

Referring to FIG. 3, if the electric current is applied to the first and second metallic layers 30 and 40 from the outside, it flows through a part having a specified skin thickness from the surface of the respective metallic layer due to the skin effect, and a current depletion layer 70, through which the electric current does not flow, is created in the center part of the respective metallic layer. As the current depletion layer 70 is increased, the area through which the current flows is reduced.

In the shredded parallel stacked inductor 100 according to an exemplary embodiment of the present invention, the metallic layers 30 and 40 have the structure in which the cavity 50 is formed in the center part of the spiral conductor. The cavity 50 is formed in the center part of the spirally formed metallic layers 30 and 40 at predetermined intervals, and has the same spiral arrangement as those of the plural metallic layers 30 and 40. Since cavity 50 is formed in the metallic layers, the size of the current depletion layer 70 may be reduced in comparison to the conventional conductor.

Accordingly, as the surface area through which the electric current flows is increased, a loss resulted from the skin effect may be reduced, and this reduced loss causes the Q factor of the inductor 100 to be improved.

The resistance of the conductor is related to the length and the surface area of the conductor, and may be expressed by Equation (2).

$$R = \frac{l}{A} \tag{2}$$

In Equation (2), A denotes a sectional area of the conductor through which the electric current flows, l denotes a length of the conductor, and R denotes the resistance of the conductor. Since the shredded parallel stacked inductor 100 according to an exemplary embodiment of the present invention has the structure in which the first and second metallic layers 30 and 40 are joined in parallel, the sectional area through which the electric current flows is increased, and thus the resistance is reduced. This reduction causes the loss of the electric current flowing through the first and second metallic layers 30 and 40 to be reduced.

Figure 4:
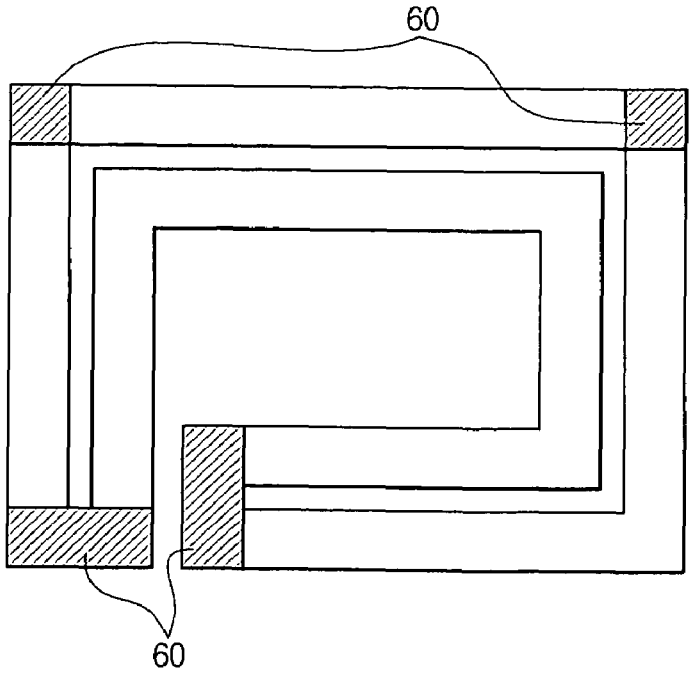
FIG. 4 is a view illustrating junction positions of vias in FIG. 2.

FIG. 4 is a view illustrating the junction positions of the vias in FIG. 2. Referring to FIG. 4, the vias 60 are not positioned in the whole region of the metallic layers 30 and 40, but are positioned in some parts of the metallic layers in order to join the first metallic layer 30 and the second metallic layer 40. In an exemplary embodiment of the present invention, the vias are formed in four parts of the metallic layers, i.e., the proximal part, distal part, left corner and right corner of the metallic layers. If the junctions of the vias 60 are positioned in the whole region of the first and second metallic layers, the skin effect of the metallic layers occurs increasingly to deteriorate the Q factor of the inductor.

The junction positions of the vias 60 are not necessarily limited to the regions as shown in FIG. 4. Since the junction positions of the vias 60 are related to the Q factor of the inductor, it is advantageous to position the junctions of the vias in regions where the Q factor can be experimentally increased.

Figure 5:
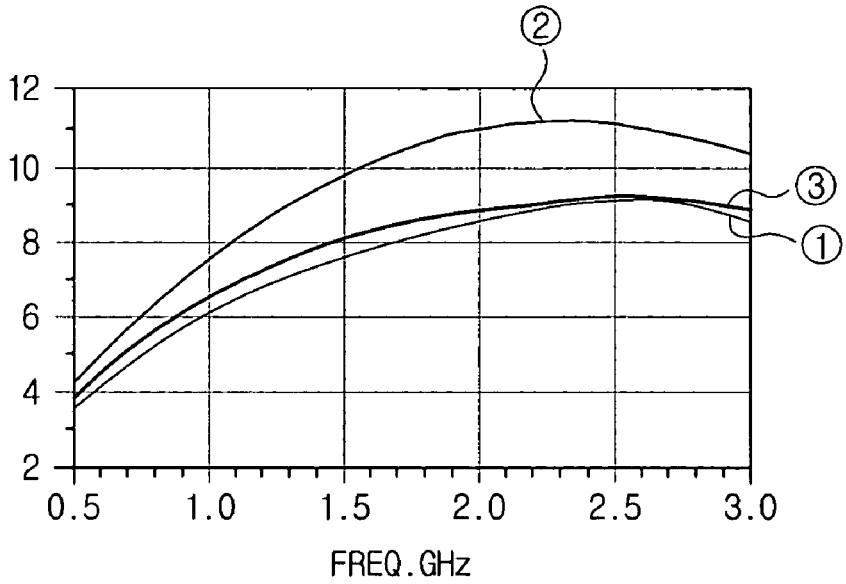
FIG. 5 is a graph depicting the results of a first simulation in order to indirectly compare the performance of a shredded parallel stacked inductor according to an exemplary embodiment of the present invention with a general inductor.

FIG. 5 is a graph depicting the results of a first simulation in order to indirectly compare the performance of a shredded parallel stacked inductor according to an exemplary embodiment of the present invention with a general inductor. Referring to FIG. 5, a curve ① indicates the value Q of the general inductor, a curve ② indicates the value Q of the shredded parallel stacked inductor in which a cavity is formed in the center part of metallic layers, and a curve ③ indicates the value Q of an inductor having a structure in which the plurality of metallic layers are joined by vias. In this case, the vias are positioned at the proximal part, distal part and four corners of the metallic layers.

Considering the simulation results, the maximum value Q of the general inductor is about 9.1, while the maximum value Q of the shredded parallel stacked inductor is about 11.2. That is, the value Q of the shredded parallel stacked inductor is about 23% higher than that of the general inductor. Meanwhile, the maximum value Q of the inductor having the structure in which the plurality of metallic layers are joined by vias is about 9.2. In this case, the value Q is not almost increased in comparison to the general inductor.

Figure 6:
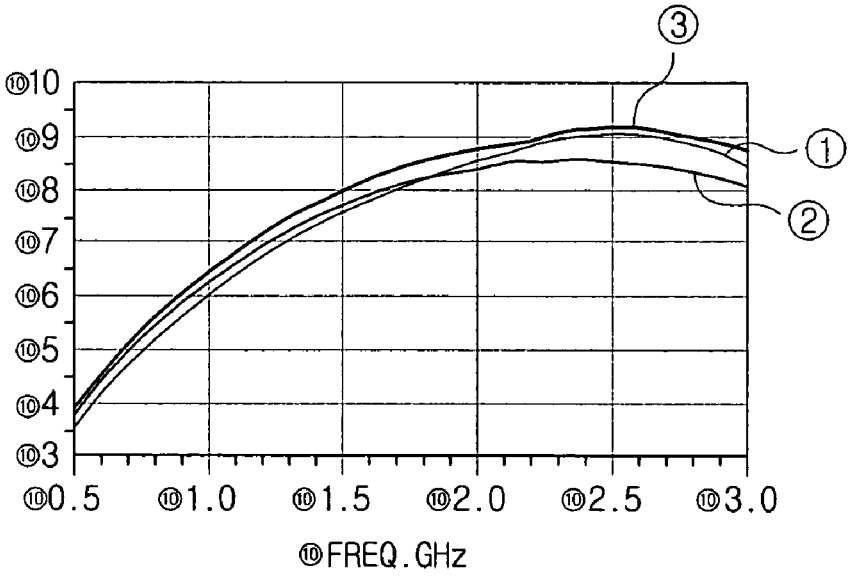
FIG. 6 is a graph depicting the results of a second simulation in order to indirectly compare the performance of a shredded parallel stacked inductor according to an exemplary embodiment of the present invention with a general inductor.

FIG. 6 is a graph depicting the results of a second simulation in order to indirectly compare the performance of the shredded parallel stacked inductor according to an exemplary embodiment of the present invention with a general inductor. Referring to FIG. 6, a curve ① indicates the value Q of the general inductor, and a curve ② indicates the value Q of the shredded parallel stacked inductor with a plurality of metallic layers joined by vias, in which two vias are positioned at the proximal part and the distal part of the metallic layers. A curve ③ indicates the value Q of an inductor with a plurality of metallic layers joined by vias, in which the vias are positioned at the proximal part, distal part and four corners of the metallic layers.

Considering the simulation results, the maximum value Q of the shredded parallel stacked inductor (curve ② is about 8.5. That is, the value Q of the shredded parallel stacked inductor is lower than that of the general inductor. Meanwhile, the maximum value Q of the inductor with a plurality of metallic layers joined by the vias (curve ③) is about 9.2. That is, the value Q is similar to that of the general inductor.

Figure 7:
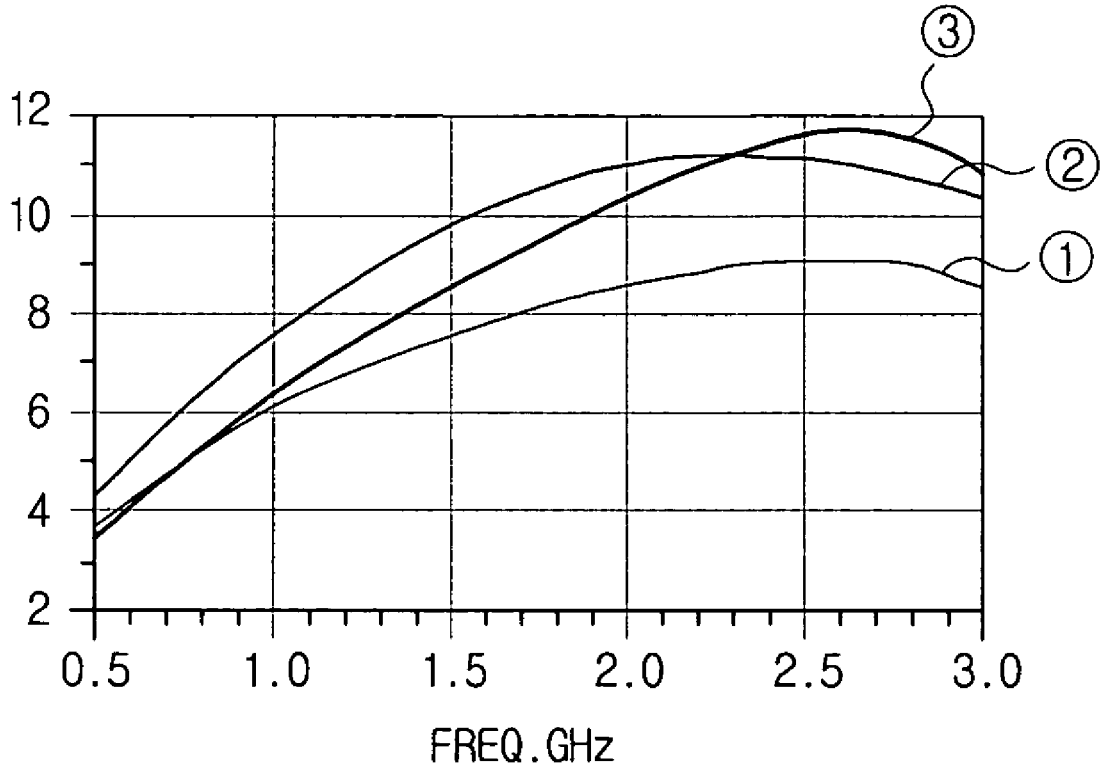
FIG. 7 is a graph depicting the results of a third simulation in order to indirectly compare the performance of a shredded parallel stacked inductor according to an exemplary embodiment of the present invention with a general inductor.

FIG. 7 is a graph depicting the results of a third simulation in order to indirectly compare the performance of the shredded parallel stacked inductor according to an exemplary embodiment of the present invention with a general inductor. Referring to FIG. 7, a curve ① indicates the value Q of the general inductor, and a curve ② indicates the value Q of an inductor having two shredded metallic layers formed by one cavity. In this case, the width of the cavity formed in the metallic layers is set to 2 μm. A curve ③ indicates the value Q of an inductor having three shredded metallic layers formed by two cavities. In this case, the width of the respective cavities formed in the metallic layers is set to about 0.5 μm.

Considering the simulation results, the maximum value Q of the general inductor is about 9.1, while the maximum value Q of the inductor having one cavity is about 11.1. That is, the value Q of the inductor having one cavity is 23% higher than that of the general inductor. Also, the maximum value Q of the inductor having two cavities is about 11.7. That is, the value Q of the inductor having two cavities is 29% higher than that of the general inductor.

As described above, according to an exemplary embodiment of the present invention, a cavity or cavities are formed in the center part of plural metallic layers, and the current depletion layer is reduced in comparison to the general conductor when an electric current is applied to the inductor. Hence, the loss resulted from the skin effect is reduced, and the Q factor of the inductor is improved.

In addition, by reducing the resistance of the metallic layers by joining a plurality of metallic layers in parallel using vias, the Q factor of the inductor can be improved.

The foregoing embodiments are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A shredded parallel stacked inductor comprising:

a substrate;

an oxide film formed on the substrate;

a plurality of metallic layers spirally formed within the oxide film; and a plurality of vias formed in regions of the plurality of metallic layers to join the plurality of metallic layers in parallel, wherein a spiral cavity is formed in the plurality of metallic layers.

2. The shredded parallel stacked inductor as claimed in claim 1, wherein the regions are proximal parts of the plurality of metallic layers.

3. The shredded parallel stacked inductor as claimed in claim 1, wherein the regions are distal parts of the plurality of metallic layers.

4. The shredded parallel stacked inductor as claimed in claim 1, wherein the regions are corner parts of the plurality of metallic layers.

5. The shredded parallel stacked inductor as claimed in claim 1, wherein the spiral cavity is formed in a center part of the plurality of metallic layers except for at the proximal and distal parts of the metallic layers.

6. The shredded parallel stacked inductor as claimed in claim 1, wherein a current depletion layer of each of the plurality of the metallic layers is reduced by the spiral cavity when electric current is applied to the inductor.

7. The shredded parallel stacked inductor as claimed in claim 1, wherein the shredded parallel stacked inductor has a structure stacked in parallel by the vias.

8. The shredded parallel stacked inductor as claimed in claim 1, wherein long sides of the plurality of metallic layers have a length of about 10 μm, and short sides of the plurality of metallic layers have a length of about 3 μm.

* * * * *